US005273184A

United States Patent [19]

Rizzuto

[11] Patent Number: 5,273,184

[45] Date of Patent: Dec. 28, 1993

[54] ROLL PRODUCT DISPENSER WITH LIQUID SHIELD

[75] Inventor: Jack A. Rizzuto, Antioch, Calif.

[73] Assignee: James River Paper Company, Inc., Richmond, Va.

[21] Appl. No.: 5,559

[22] Filed: Jan. 19, 1993

[51] Int. Cl.[5] ..... A47F 1/08

[52] U.S. Cl. ..... 221/303; 221/286

[58] Field of Search ..... 221/303, 45, 282, 286, 221/307

[56] References Cited

U.S. PATENT DOCUMENTS

| | | | |
|---|---|---|---|
| 837,479 | 12/1906 | Lazar | 221/45 |
| 1,423,336 | 7/1922 | Korittke | 225/47 X |
| 1,676,854 | 7/1926 | Casterline | 225/47 X |
| 3,865,323 | 2/1975 | Stronge et al. | 312/34.8 X |
| 4,739,943 | 4/1988 | Geller | 242/55.2 |
| 4,790,490 | 12/1988 | Chakravorty | 225/43 X |
| 4,811,878 | 3/1989 | Horinchi | 225/46 |
| 4,905,868 | 3/1990 | Beane et al. | 221/48 X |
| 4,915,256 | 4/1990 | Bailey | 22/48 |
| 4,941,311 | 7/1990 | Arduesser et al. | 53/587 |
| 4,944,466 | 7/1990 | Jespersen | 242/55.3 |
| 5,069,378 | 12/1991 | Baumann | 225/52 X |
| 5,211,308 | 5/1993 | Decker et al. | 221/303 X |

*Primary Examiner*—Robert P. Olszewski
*Assistant Examiner*—Dean A. Reichard
*Attorney, Agent, or Firm*—Thomas R. Lampe

[57] ABSTRACT

Dispenser apparatus for roll products such as paper towels which includes a housing and a dispenser nozzle through which projects the lead end of a roll product disposed within the housing. The apparatus includes an internal shield located in the interior of the housing to protect the roll product from water or other liquid entering the housing. An external shield is disposed about the dispenser nozzle to protect the dispenser nozzle and the roll product lead end from water or other liquid and allow manual access to the lead end.

13 Claims, 2 Drawing Sheets

ROLL PRODUCT DISPENSER WITH LIQUID SHIELD

TECHNICAL FIELD

This invention relates to the dispensing of sheet material from a roll product such as a roll of paper toweling. More particularly, the apparatus incorporates shield a structure which protects a paper roll therein from liquid impact.

BACKGROUND ART

A number of dispensers exist in the prior art for dispensing paper toweling and the like. Some of these dispensers are of the "center-pull" type wherein a web of paper toweling or other sheet material is pulled from the center of a coreless roll through a nozzle or other restrictor element forming a restricted passageway. Assuming that the individual sheets of toweling or the like are connected by perforated lines, as is common, the nozzle or other restrictor element will resist pulling of the sheet material by the user and cause an individual sheet to break from the remaining web along the perforated line interconnecting same. Similar arrangements exist wherein sheets are torn from a non-perforated web, often incorporating cutter teeth or blades to sever a manually manipulated sheet from the web. U.S. Pat. No. 4,905,868, issued Mar. 6, 1990, illustrates a representative paper towel dispenser incorporating a restrictor element in the form of a nozzle.

Dispensers for roll products such as paper toweling are occasionally installed at locations where the dispensers are impacted by water or other liquids. For example, it is common to locate paper towel dispensers in factories, food processing plants, and other facilities which are periodically sprayed with water or other liquid to maintain the work environment in a clean condition or as a consequence of the operations carried out in the facilities. Also, paper towel and other dispensers disposed at an outdoor location can be impacted by rain.

It will be appreciated that paper toweling or similar roll products disposed in a dispenser can be harmed or even completely ruined when brought into engagement with water or other liquid impacting the exterior of the dispenser in which the roll product is positioned. Furthermore, in the case of center-pull products, the roll product lead end projecting from the nozzle or other restrictor element will also become wet and unsuitable for use. A wet lead end projecting from a center-pull dispenser can be deteriorated by liquid to such an extent that it will break or come apart in the user's hand and consequently not be used to pull the toweling or other roll product web through the restrictor element.

A search directed to the invention disclosed in this application located the following U.S. Pat. Nos.: 5,069,378, issued Dec. 3, 1991, 4,790,490, issued Dec. 13, 1988, 4,944,466, issued Jul. 31, 1990, 4,739,943, issued Apr. 26, 1988, 4,941,311, issued Jul. 17, 1990, 3,865,323, issued Feb. 11, 1975, 4,915,257, issued Apr. 10, 1990, 1,676,854, issued Jul. 10, 1928, 4,811,878, issued Mar. 14, 1989, and 1,423,336, issued Jul. 18, 1922.

While a number of dispenser constructions having water-tight or moisture resistant housings were located in the search, none of the arrangements were applicable for use in connection with center-pull dispensing of paper toweling or similar products.

DISCLOSURE OF INVENTION

The present invention relates to apparatus for dispensing individual sheets from a roll product including a plurality of said sheets forming a wound web having a lead end and a tail end.

The housing includes a housing base having a bottom wall defining an aperture for accommodating the lead end of a roll product.

A housing cover having an outer wall is positionable over the housing base and the housing cover outer wall is releasably connectable to the housing base at a juncture spaced from the bottom wall to define a housing interior for accommodating a roll product.

Internal shield means is located in the interior and disposed between the juncture and a roll product in the housing interior to shield the roll product from impact by liquid entering the housing interior through the juncture.

The housing base further includes a side wall extending upwardly from the bottom wall, the juncture being located at a level above the bottom wall. The shield means includes a shield wall adjacent to the housing cover outer wall and in at least partial registry with the juncture.

The housing base defines a drain channel and a drain hole for draining liquid entering the housing interior through the juncture.

The apparatus additionally comprises restrictor means projecting downwardly from the housing base bottom wall. The restrictor means defines a passageway in communication with the aperture for accommodating the lead end of a roll product and having a restrictor means outlet communicating with the passageway and spaced from the aperture.

External shield means projects downwardly from the housing base and extends about the restrictor means and below the restrictor means to protect the restrictor means from liquid directed toward the restrictor means.

Other features, advantages, and objects of the present invention will become apparent with reference to the following description and accompanying drawings.

BEST MODE FOR CARRYING OUT THE INVENTION

Figure 1:
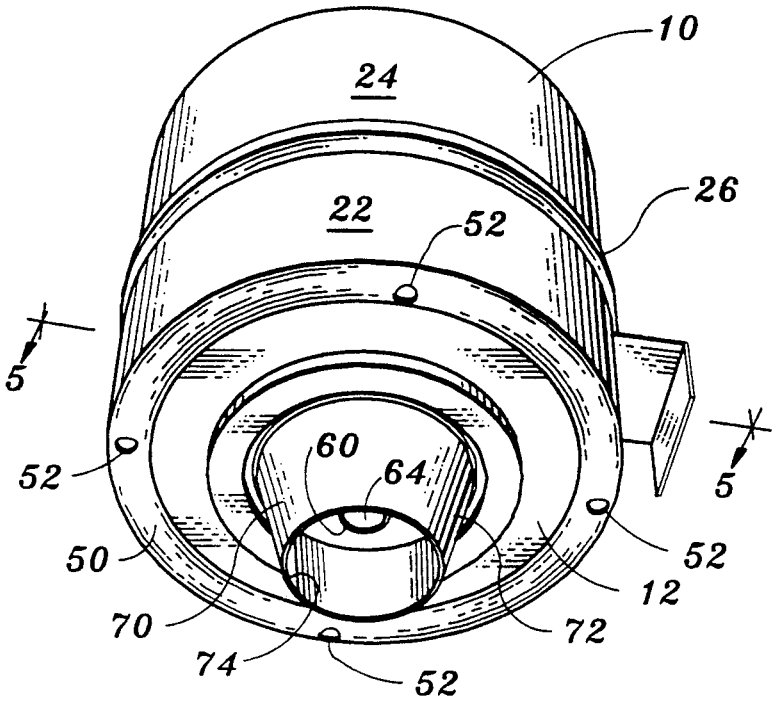
FIG. 1 is perspective, bottom view of apparatus constructed in accordance with the teachings of the present invention.

Referring now to the drawings, apparatus constructed in accordance with the teachings of the present invention is illustrated. The apparatus includes a housing including a housing cover 10 and a housing base 12. The housing cover and housing base may be formed of any suitable material such as molded plastic, as may the other components of the apparatus to be described below.

Figure 2:
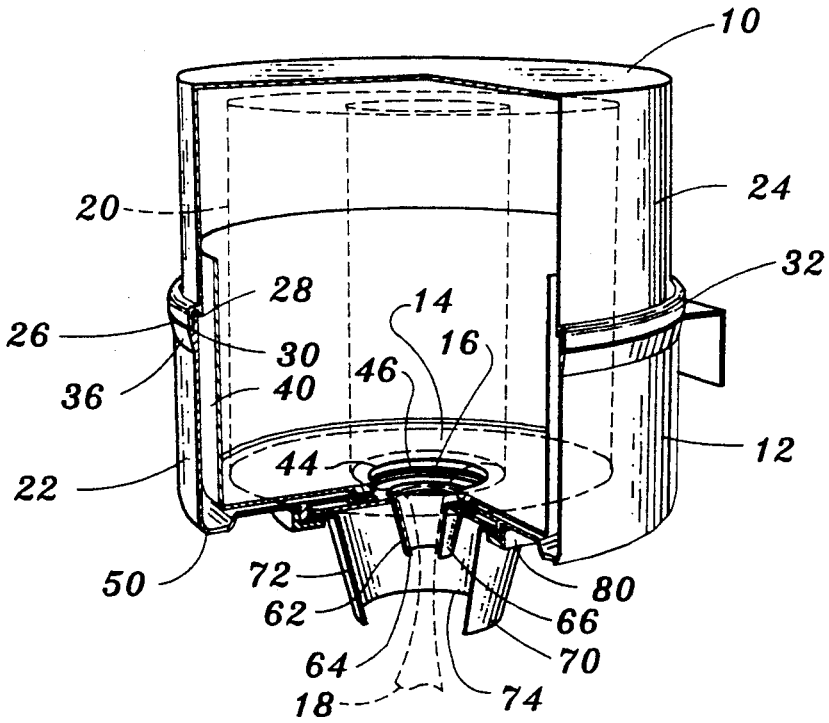
FIG. 2 is a perspective, side view of the apparatus with a portion thereof broken away.
Figure 3:
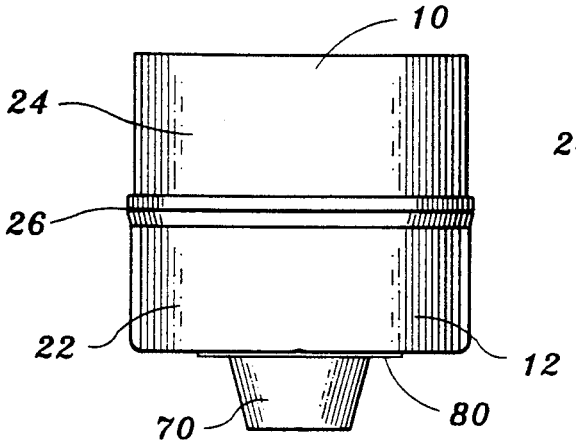
FIG. 3 is a front view of the apparatus.
Figure 4:
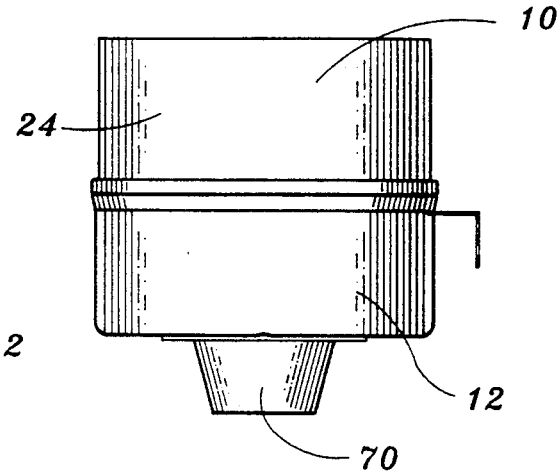
FIG. 4 is a side view of the apparatus.
Figure 5:
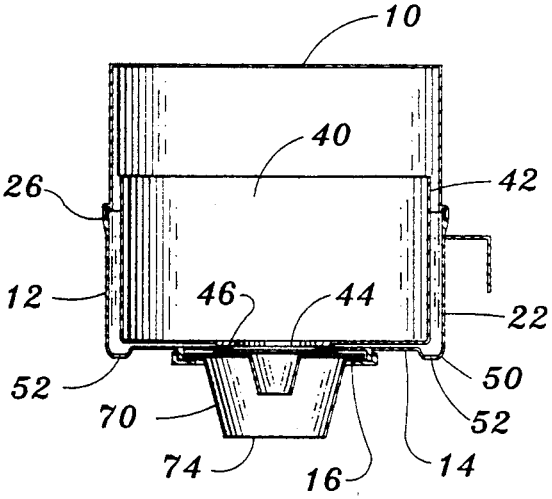
FIG. 5 is a sectional view taken along the line 5—5 of FIG. 1.
Figure 6:
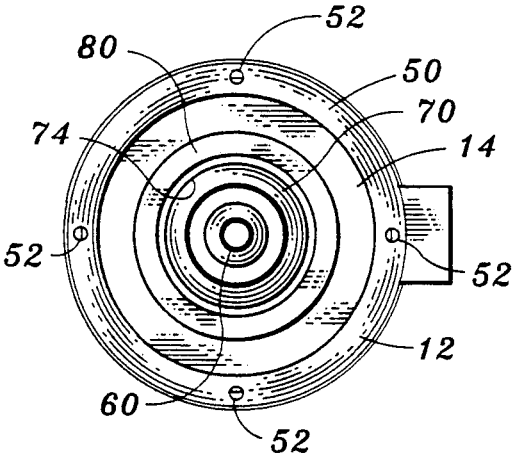
FIG. 6 is a bottom view of the apparatus.
Figure 7:
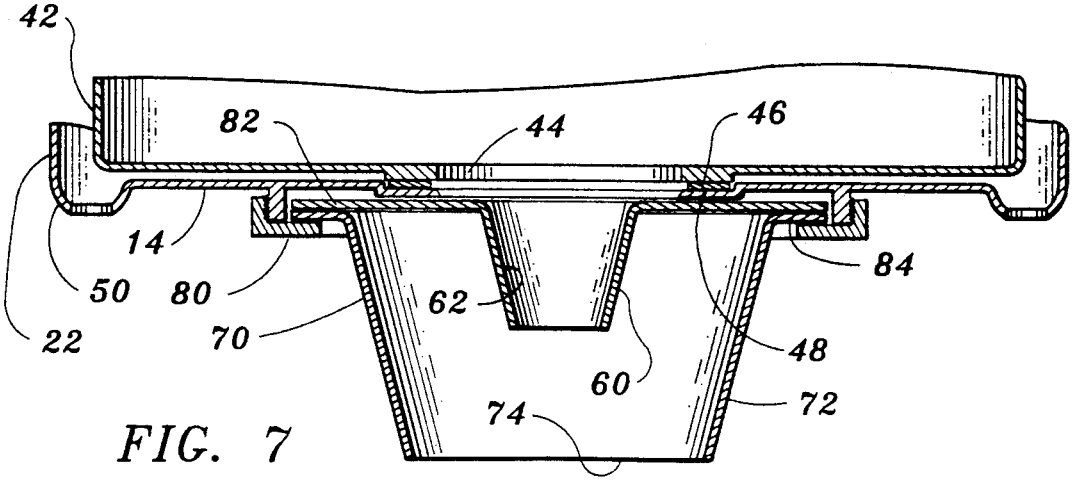
FIG. 7 is an enlarged sectional view of a portion of the apparatus.

The housing base includes a bottom wall 14 defining an aperture 16 for accommodating the lead end 18 (FIG. 2) of a coreless roll product 20 which, for illustrative purposes, is a paper towel. As is conventional in center-pull dispensing arrangements, the towel 20 is disposed on end and centered within the housing. The towel is dispensed by a consumer manually grasping the lead end 18 and pulling same downwardly to remove individual towels from the web forming the roll product. In other words, the roll product is dispensed from the inside out, with the tail end of the web forming the roll product being disposed at the outer periphery thereof.

The housing base 12 includes a side wall 22 extending upwardly from the bottom wall 14. The housing cover 10 has an outer wall 24 which has essentially the same configuration as side wall 22, in this instance, a round configuration. When assembling the housing, the outer wall 24 is positioned on side wall 22 at a juncture 26. The outer wall 24 of the housing cover has a lower rim 28 which engages and is situated upon an upper rim 30 of the housing base. The rims 28, 30 define a non-linear cross-section at the juncture 26, the rim 28 including a lip 32 receiving and extending over the top-most segment of side wall 22, and side wall 22 having a ledge 36 for engagement by the lip. This arrangement affords some degree of assurance that liquid impacting the housing will, for the most part, remain exterior of the housing.

Disposed within the interior of the housing is an internal shield 40 having shield wall 42. A hole 44 is formed in the bottom of internal shield 40 and hole 44 is generally aligned with the aperture 16 in base 12. A boss 46 surrounds the hole 44 and matingly engages and is disposed in a recess 48 formed at the bottom wall of housing base 12 to connect together the housing base and internal shield to maintain a fixed relative position therebetween.

It will be seen that the shield wall 42 is located adjacent to the outer wall 24 and in partial registry with junction 26. Any liquid entering the housing interior through the juncture will contact the internal shield 40 and flow under the force of gravity downwardly along shield wall 42. Thus, the toweling or other paper roll disposed within the housing interior is protected against contact by the water or other liquid.

The liquid flowing downwardly in the annular passageway defined by side wall 22 and shield wall 42 will drip into a channel 50 formed about the periphery of housing base bottom wall 14. A plurality of drain holes 52 allow the liquid within the channel to drip or flow out of the housing interior.

The apparatus of the present invention also includes restrictor means in the form of a dispenser nozzle 60 which has a generally conical configuration. The dispenser nozzle 60 defines a passageway 62 in communication with aperture 16 in housing base 12. The passageway 62 accommodates the lead end 18 of the roll product within the dispenser housing. The lead end projects outwardly through a restricted outlet 64 which exerts a frictional force on the lead end when the lead end is being manually puller from the dispenser nozzle. As indicated above, this action is quite conventional in the center-pull dispenser art and the force exerted by the dispenser nozzle on the toweling passing therethrough results in separation of an individual sheet of toweling from the remainder of the web along a perforation line (not shown) in the web.

The apparatus includes an external shield 70 which projects downwardly from the housing base and extends about the dispenser nozzle 60 and below the dispenser nozzle 60 to protect the dispenser nozzle from liquid directed toward the nozzle from the side thereof. External shield 70 includes a tapered shield wall 72 and defines an access opening 74 sufficiently large to allow manual access to the lead end 18 extending from the dispenser nozzle opening 64.

Both the external shield 70 and dispenser nozzle 60 are maintained in place by a securement ring 80 threadedly engaged to the housing base 12. Dispenser nozzle 60 has a flange 82 and external shield 70 has a flange 84, said flanges being in engagement and secured to the housing base by securement ring 80. When the dispenser nozzle and the external shield are fixed in position, the dispenser nozzle and the tapered shield wall 72 of the external shield define an annular space therebetween large enough to accommodate a human finger to allow manual access to

I claim:

1. Apparatus for dispensing individual sheets from a roll product including a plurality of said sheets forming a wound web having a lead end and a tail end, said apparatus comprising:

a housing base including a bottom wall defining an aperture for accommodating the lead end of a roll product;

a housing cover having an outer wall, said housing cover positionable over said housing base and the housing cover outer wall releasably connectable to said housing base at a juncture spaced from said bottom wall to define a housing interior for accommodating a roll product; and internal shield means located in said interior and disposed between said juncture and a roll product in said housing interior to shield said roll product from impact by liquid entering said housing interior through said juncture.

2. The apparatus according to claim 1 wherein said housing base further includes a side wall extending upwardly from said bottom wall, said juncture being located at a level above said bottom wall, and said shield means including a shield wall adjacent to said outer wall and in at least partial registry with said juncture.

3. The apparatus according to claim 1 wherein said housing base defines at least one drain hole for draining liquid entering said housing interior through said juncture.

4. The apparatus according to claim 1 additionally comprising connector means for connecting said shield means to said housing base to maintain said shield means spaced from said housing cover outer wall when said housing cover is connected to said housing base.

5. The apparatus according to claim 3 wherein a drain channel is defined by said housing base bottom wall below at least a portion of said shield means, said drain hole being located in said drain channel.

6. The apparatus according to claim 1 additionally comprising restrictor means projecting downwardly from said housing base bottom wall, said restrictor means defining a passageway in communication with said aperture for accommodating the lead end of a roll product and having a restrictor means outlet communicating with said passageway and spaced from said aperture, and external shield means projecting downwardly from said housing base and extending about the restrictor means and below the restrictor means to protect the restrictor means from liquid directed toward the restrictor means.

7. The apparatus according to claim 6 wherein said restrictor means includes a dispenser nozzle having a generally conical configuration, and wherein said opening is restricted to exert a frictional force on the lead end when said lead end is being manually pulled from said dispenser nozzle, said external shield means including a tapered shield wall extending downwardly from the housing base about the dispenser nozzle and defining an access opening sufficiently large to allow manual access to a lead end extending from said dispenser nozzle opening.

8. The apparatus according to claim 7 wherein said dispenser nozzle includes a flange and wherein said external shield means includes a flange, said apparatus including means for securing said dispenser nozzle flange and said external shield means flange together and to said housing base.

9. The apparatus according to claim 2 wherein said housing base side wall and said housing cover outer wall have ends including rims matingly engaged when said housing cover is connected to said housing base to define a non-linear cross-section at said juncture.

10. Apparatus for dispensing individual sheets from the center of a coreless roll product including a plurality of said sheets forming a wound web having a lead end and a tail end, said lead end projectable outwardly from said coreless roll product center, said apparatus comprising:

a housing defining an interior for accommodating a coreless roll product and including a bottom wall defining an aperture for accommodating the lead end of a coreless roll product;

restrictor means projecting downwardly from said housing and defining a passageway in communication with said aperture for accommodating a coreless roll product lead end extending from said aperture, said restrictor means having a restricted outlet communicating with said passageway and spaced from said aperture; and external shield means projecting downwardly from the housing and extending about the restrictor means and below the restrictor means to shield the restrictor means from liquid directed toward the restrictor means.

11. The apparatus according to claim 10 wherein said restrictor means comprises a dispenser nozzle having a generally conical configuration and wherein the restricted outlet exerts a frictional force on the lead end when said lead end is being manually pulled from said dispenser nozzle, said external shield means including a tapered shield wall extending downwardly from the housing about the dispenser nozzle and defining an access opening sufficient large to allow manual access to a lead end extending from said restricted outlet.

12. The apparatus according to claim 11 wherein said dispenser nozzle includes a flange and wherein said external shield means includes a flange, said apparatus including means for securing said dispenser nozzle flange and said external shield means flange together and to said housing.

13. The apparatus according to claim 11 wherein said dispenser nozzle and said tapered shield wall define an annular space therebetween large enough to accommodate a human finger.

* * * * *